US011548538B2

(12) United States Patent
Tanigawa et al.

(10) Patent No.: US 11,548,538 B2
(45) Date of Patent: Jan. 10, 2023

(54) HEATING FLOOR PANEL UNIT AND FLOOR STRUCTURE OF RAILCAR

(71) Applicant: KAWASAKI RAILCAR MANUFACTURING CO., LTD., Kobe (JP)

(72) Inventors: Toshinobu Tanigawa, Kobe (JP); Takahiro Kawashima, Nishinomiya (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 954 days.

(21) Appl. No.: 16/338,512

(22) PCT Filed: Sep. 30, 2016

(86) PCT No.: PCT/JP2016/004429

§ 371 (c)(1),
(2) Date: Apr. 1, 2019

(87) PCT Pub. No.: WO2018/061062

PCT Pub. Date: Apr. 5, 2018

(65) Prior Publication Data

US 2020/0039540 A1 Feb. 6, 2020

(51) Int. Cl.
*B61D 27/00* (2006.01)
*B61D 17/10* (2006.01)

(52) U.S. Cl.
CPC ..... *B61D 27/0036* (2013.01); *B61D 17/10* (2013.01)

(58) Field of Classification Search
CPC ..... B61D 27/0036
USPC ..... 219/202; 105/422
See application file for complete search history.

(56) References Cited

U.S. PATENT DOCUMENTS

2012/0067862 A1 3/2012 Anderegg

FOREIGN PATENT DOCUMENTS

| | | | | |
|---|---|---|---|---|
| JP | H03-287454 | A | | 12/1991 |
| JP | 04169609 | A | * | 6/1992 |
| JP | H04-169609 | A | | 6/1992 |
| JP | 2544823 | B2 | * | 10/1996 |
| JP | 3170344 | B2 | * | 5/2001 |
| JP | 2002348976 | A | * | 12/2002 |
| JP | 5756459 | B2 | | 7/2015 |
| UA | 40342 | U | * | 4/2009 |

* cited by examiner

*Primary Examiner* — Tu B Hoang
*Assistant Examiner* — Alba T Rosario-Aponte
(74) *Attorney, Agent, or Firm* — Oliff PLC

(57) ABSTRACT

A heating floor panel unit of a railcar includes: a heater-equipped floor panel; a first flange horizontally projecting from one end of the floor panel in a car longitudinal direction and fixed to a carbody by a fastening member; and a second flange horizontally projecting from the other end of the floor panel in the car longitudinal direction and fixed to the carbody by a fastening member. The first flange and the second flange are located at such a height that upper ends of the fastening members are located below an upper surface of the heater-equipped floor panel. The first flange, as viewed from above, is located in such a manner that a position of the first flange in a direction orthogonal to a direction in which the first flange projects does not overlap a position of the second flange in the orthogonal direction.

4 Claims, 3 Drawing Sheets

HEATING FLOOR PANEL UNIT AND FLOOR STRUCTURE OF RAILCAR

TECHNICAL FIELD

The present invention relates to a heating floor panel unit and floor structure of a railcar.

BACKGROUND ART

As car interior heating equipment for railcars, there is known a structure having heaters embedded in floor panels mounted in a carbody, the structure serving to heat air in the vicinity of the floor surface in the car interior space (see PTL 1, for example). In general, such a heating floor structure is constituted by a plurality of heater-equipped floor panels each extending in a car width direction and arranged in a car longitudinal direction, each of the heater-equipped floor panels being fixed to a floor bodyshell of a carbody. Known methods for fixing heater-equipped floor panels to a carbody include a method using an adhesive and a method using screws.

CITATION LIST

Patent Literature

PTL 1: Japanese Patent No. 5756459

SUMMARY OF INVENTION

Technical Problem

Heaters of heater-equipped floor panels may undergo failure, and the occurrence of failure of the heater of one heater-equipped floor panel causes the need for detaching only this heater-equipped floor panel from the carbody to replace the panel with another.

When floor panels are fixed to a carbody with an adhesive, the adhesive is applied to the lower surface of the floor panel. Thus, the adhesive cannot be removed by access from the upper surface-side of the floor panel, and detachment of each floor panel is difficult. Even if one floor panel is detached forcibly, another adjacent floor panel whose heater is free of failure may also be damaged.

When floor panels are fixed to a carbody with screws, each floor panel can be detached by using a tool and making access to the screws from above the floor panel. However, the portions where the screws are attached are often filled with a sealing material in order to ensure waterproofness and aesthetic quality. In such a case, the sealing material adheres to the heads of the screws, and a lot of time is required for the work of removing the sealing material completely from the heads of the screws. It may be conceivable to dispose a specific fixing mechanism in a space between the adjacent floor panels; however, a widening of the space due to the fixing mechanism leads to non-uniform heating effect in the vicinity of the floor surface in the car interior space.

It is therefore an object of the present invention to provide a configuration adapted to keep uniform the heating effect in the vicinity of a floor surface of a car interior space and at the same time permit one heating floor panel unit in need of replacement to be easily detached alone in maintenance operation.

Solution to Problem

A heating floor panel unit of a railcar according to an aspect of the present invention includes: a heater-equipped floor panel; a first flange horizontally projecting to one side in a car longitudinal direction from one end of the heater-equipped floor panel in the car longitudinal direction and fixed to a carbody by a fastening member; and a second flange horizontally projecting to the other side in the car longitudinal direction from the other end of the heater-equipped floor panel in the car longitudinal direction and fixed to the carbody by a fastening member. The first flange and the second flange are located at such a height that upper ends of the fastening members are located below an upper surface of the heater-equipped floor panel, and the first flange is located in such a manner that a position of the first flange in a direction orthogonal to a direction in which the first flange projects does not overlap a position of the second flange in the orthogonal direction.

With the above configuration, the flanges of the heating floor panel units arranged adjacent to each other do not overlap each other when viewed from above. This makes it possible to detach one heating floor panel unit alone from the carbody without detaching another heating floor panel unit from the carbody. Moreover, since the flanges of the adjacent heating floor panel units are located at different positions, the adjacent floor panels can be placed close to each other without interference between the flanges, so that uniform heating effect can be achieved. Additionally, since the flanges projecting from the floor panels are located at such a height that the upper ends of the fastening members are located below the upper surface of the floor panel, a sealing material to fill the space between the floor panels can easily be kept away from the fastening members.

Advantageous Effects of Invention

According to the present invention, heating effect in the vicinity of a floor surface of a car interior space can be kept uniform, and at the same time one heating floor panel unit in need of replacement can easily be detached alone in maintenance operation.

DESCRIPTION OF EMBODIMENTS

Hereinafter, an embodiment will be described with reference to the drawings.

Figure 1:
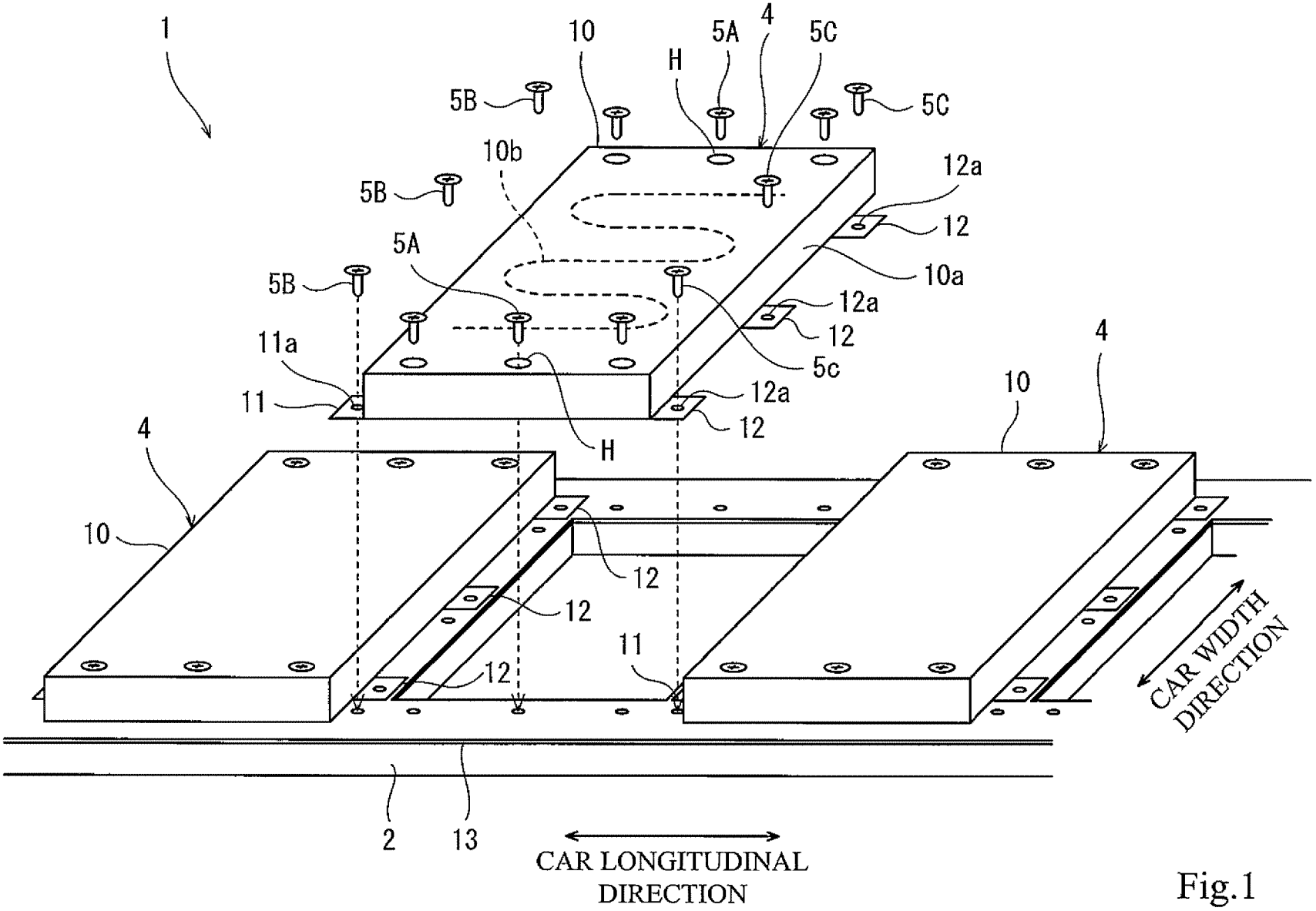
FIG. 1 is a perspective view of a heating floor structure of a railcar according to an embodiment.
Figure 2:
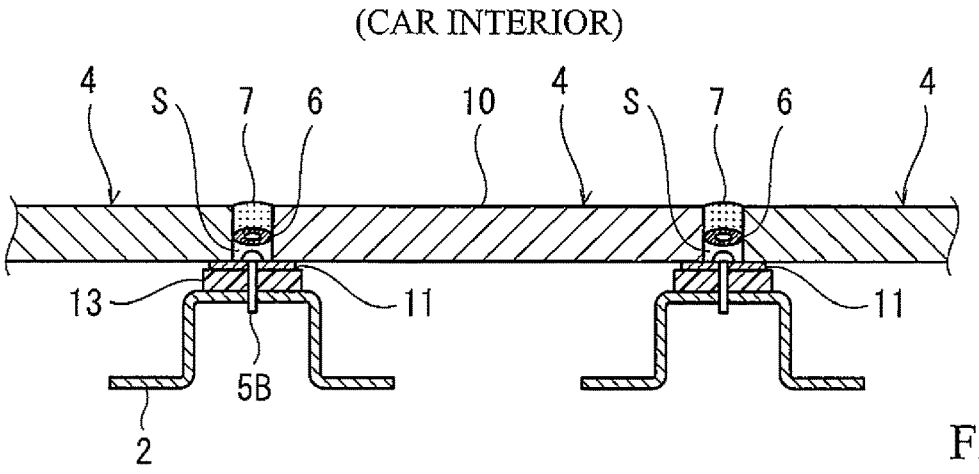
FIG. 2 is a cross-sectional view of the heating floor structure of FIG. 1 as viewed in a car width direction.

FIG. 1 is a perspective view of a heating floor structure 1 of a railcar according to an embodiment. FIG. 2 is a cross-sectional view of the heating floor structure 1 of FIG. 1 as viewed in a car width direction. As shown in FIGS. 1 and 2, the heating floor structure 1 of a railcar serves both as the floor of a car interior space and as heating equipment for the car interior space, and is fixed to a floor bodyshell 2 of a carbody. The floor bodyshell 2 includes an underframe and a floor-supporting member fixed to the underframe. The heating floor structure 1 includes a plurality of heating floor panel units 4, a plurality of fastening members 5A to 5C, a plurality of filler receivers 6, and a filler 7.

The heating floor panel units 4 are arranged with spaces S therebetween in a car longitudinal direction. Each heating floor panel unit 4 includes a heater-equipped floor panel 10, first flanges 11, and second flanges 12. The heater-equipped floor panel 10 includes a panel 10*a* extending in the car width direction between a pair of side bodyshells (not shown) and a heater 10*b* embedded in the panel 10*a*. The heater-equipped floor panel 10 as viewed in plan is in the shape of a rectangle extending longitudinally in the car width direction. The heater-equipped floor panel 10 includes insertion holes H at both ends in its longitudinal direction (the car width direction).

The first flanges 11 and the second flanges 12 are joined to the heater-equipped floor panel 10. For example, the first flanges 11 and the second flanges 12 may be fixed to the panel 10*a* with fixing means or with an adhesive or may be integrally formed with the panel 10*a*. Each first flange 11 horizontally projects to one side in the car longitudinal direction from one end of the heater-equipped floor panel 10 in the car longitudinal direction and includes an insertion hole 11*a*. Each second flange 12 horizontally projects to the other side in the car longitudinal direction from the other end of the heater-equipped floor panel 10 in the car longitudinal direction and includes an insertion hole 12*a*. The first flanges 11 are staggered with respect to the second flanges 12 in the car width direction. The first and second flanges 11 and 12 are arranged at intervals in the car width direction.

In the present embodiment, the first flanges 11 are connected to the lower surface of one end of the heater-equipped floor panel 10 in the car longitudinal direction, while the second flanges 12 are connected to the lower surface of the other end of the heater-equipped floor panel 10 in the car longitudinal direction. Thus, the upper surfaces of the first flanges 11 and the second flanges 12 are located at the same height as the lower surface of the heater-equipped floor panel 10. On the upper surfaces of the flanges 11 (12) of a first heating floor panel unit 4, there lies the lower surface of the heating floor panel 10 of a second heating floor panel unit 4 adjacent to the first heating floor panel unit 4. The width of the space S in the car longitudinal direction is smaller than the length over which the first flanges 11 and the second flanges 12 project from the heating floor panels 10 in the car longitudinal direction.

The fastening members 5A to 5C are, for example, screws and may be any other type of fastening members (such as bolts or rivets) as long as the members can be attached and detached by access from above. The fastening members 5A are inserted into the insertion holes H of the heater-equipped floor panel 10 from above and fixed to the floor bodyshell 2. The upper surfaces of the two ends of the heater-equipped floor panel 10 in its longitudinal direction (the car width direction) are covered from above by a cover (not shown) provided in the side bodyshell, and hence the upper ends of the fastening members 5A are hidden by the cover.

The fastening members 5B and 5C have heads larger in diameter than the insertion holes 11*a* and 12*a*. The fastening members 5B are inserted into the insertion holes 11*a* of the first flanges 11 from above and fixed to the floor bodyshell 2, and the fastening members 5C are inserted into the insertion holes 12*a* of the second flanges 12 from above and fixed to the floor bodyshell 2. In the present embodiment, the first flanges 11 and the second flanges 12 are fixed to the floor bodyshell 2 via a spacer 13 (e.g., a rubber plate). The first flanges 11 and the second flanges 12 may be fixed directly to the floor bodyshell 2.

The heads of the fastening members 5B and 5C fixing the first flanges 11 and the second flanges 12 to the floor bodyshell 2 are situated above the upper surfaces of the first flanges 11 and the second flanges 12. The upper ends of the fastening members 5B and 5C are located below the upper surface of the heater-equipped floor panel 10. In other words, the first flanges 11 and the second flanges 12 are joined to the heater-equipped floor panel 10 at such positions that the upper ends of the fastening members 5B and 5C are located below the upper surface of the heater-equipped floor panel 10. Specifically, the upper ends of the fastening members 5B and 5C fixing the first flanges 11 and the second flanges 12 are located below the center of the heater-equipped floor panel 10 in the vertical direction.

The filler receivers 6 are inserted in the respective spaces S each formed between the heater-equipped floor panels 10 arranged adjacent to each other, and are located above the fastening members 5B and 5C. The filler receivers 6 serve as backup members for preventing the filler 7 from reaching the fastening members 5B and 5C. The filler receivers 6 only have to lie directly above the fastening members 5B and 5C. In the present embodiment, one filler receiver 6 extends within one space S in the car width direction and covers, from above, all of the fastening members 5B and 5C located in the one space S. It is preferable for the filler receivers 6 to have elasticity and to be press-fit from above in the spaces S between the adjacent heater-equipped floor panels 10. That is, the filler receivers 6 are merely in contact with the heater-equipped floor panel 10 and are not fixed to the heater-equipped floor panel 10 and the fastening members 5B and 5C. For example, elastic tubes or sponges are used as the filler receivers 6.

The filler 7 is injected into the spaces S from above the filler receivers 6 to fill the spaces S. The filler 7 may be any filler that can fill the spaces S and may be a waterproof filler. For example, various materials such as a sealing material, an adhesive, putty, and a joint sealer can be used as the filler 7.

Figure 3:
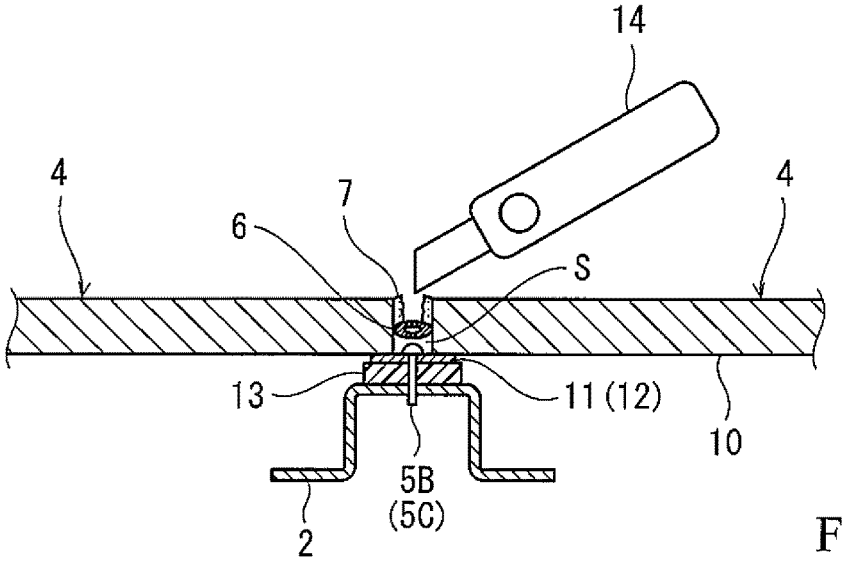
FIG. 3 is a cross-sectional view for illustrating a procedure for detaching the heating floor panel unit of FIG. 2.

The following describes a procedure for detaching the heating floor panel unit 4. As shown in FIG. 3, when one of the plurality of heating floor panel units 4 undergoes failure and needs to be replaced, the filler 7 filling the spaces S lying on both sides of the heating floor panel unit 4 in need of replacement in the car longitudinal direction is cut and removed with a tool 14 (e.g., a cutter). Next, certain portions of the filler receivers 6 are held and pulled upward to withdraw the filler receivers 6 from the spaces S. Thus, the upper ends of the fastening members 5B and 5C are exposed to the car interior space through the spaces S.

Figure 4:
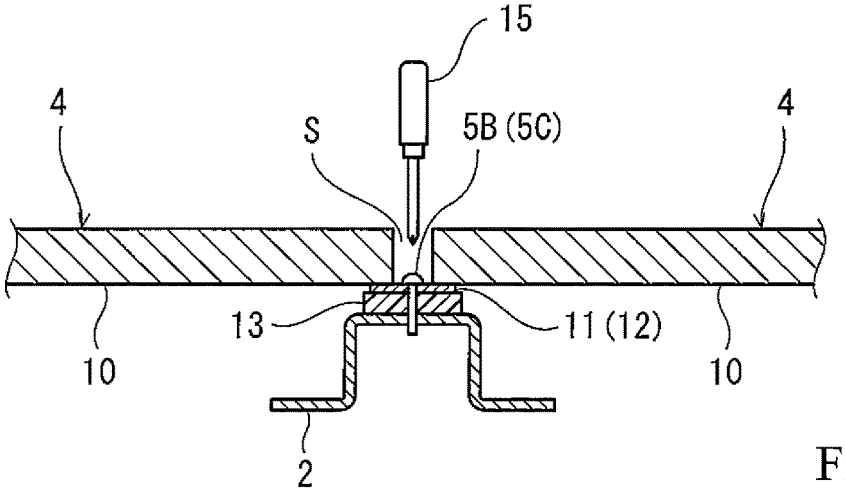
FIG. 4 is a cross-sectional view for illustrating a procedure for detaching the heating floor panel unit of FIG. 2.

Next, as shown in FIG. 4, a tool 15 (e.g., a screwdriver) for attaching and detaching the fastening members is inserted into the spaces S from the car interior space to detach the fastening members 5B and 5C fixing the first flanges 11 and second flanges 12 of the heating floor panel unit 4 in need of replacement. Among the fastening members 5B and 5C lying in one and the same space S, the fastening members 5B and 5C fixing the first flanges 11 and second flanges 12 of another adjacent heater-equipped floor panel 10 (which is not in need of replacement) do not have to be detached. The fastening members 5A (see FIG. 1) inserted in the insertion holes H of the heater-equipped floor panel 10 in need of replacement are detached by means of the tool 15 after detachment of the above-mentioned cover (not shown) covering the fastening members 5A from within the car interior. Through the procedure as described above, only the heater-equipped floor panel 10 in need of replacement is detached from the floor bodyshell 2. The procedure for attaching a new heater-equipped floor panel 10 later may be performed in reverse order to the detachment procedure.

With the configuration described above, the flanges 11 and 12 of the adjacent heating floor panel units 4 are located at different positions in the car width direction so as not to vertically overlap one another within one space S. This makes it possible to detach only a heater-equipped floor panel 10 in need of replacement without detaching any other heater-equipped floor panel 10 which is not in need of replacement. Moreover, since the flanges 11 and 12 of the adjacent heating floor panel units 4 are located at different positions in the car width direction, the adjacent heater-equipped floor panels 10 can be placed close to each other without interference between the flanges 11 and 12, so that uniform heating effect can be achieved.

Additionally, since the flanges 11 and 12 projecting from the heater-equipped floor panels 10 are located at such a height that the upper ends of the fastening members 5B and 5C are located below the upper surfaces of the heater-equipped floor panels 10, the filler 7 to fill the spaces S between the adjacent heater-equipped floor panels 10 can easily be kept away from the fastening members 5B and 5C. Specifically, the filler receivers 6 are located above the upper ends of the fastening members 5B and 5C in the spaces S and thus, when the filler 7 is injected from above to fill the spaces S, the filler 7 is received from below by the filler receivers 6. This ensures that the filler 7 is kept away from the fastening members 5B and 5C.

Additionally, since the filler receivers 6 have elasticity and are press-fit in the spaces S between the adjacent heater-equipped floor panels 10, the filler receivers 6 can be reliably inserted into the spaces S even when the spaces S vary in size. Further, the filler receivers 6 can be easily detached in maintenance operation because the detachment merely requires pulling and withdrawing the filler receivers 6.

Figure 5:
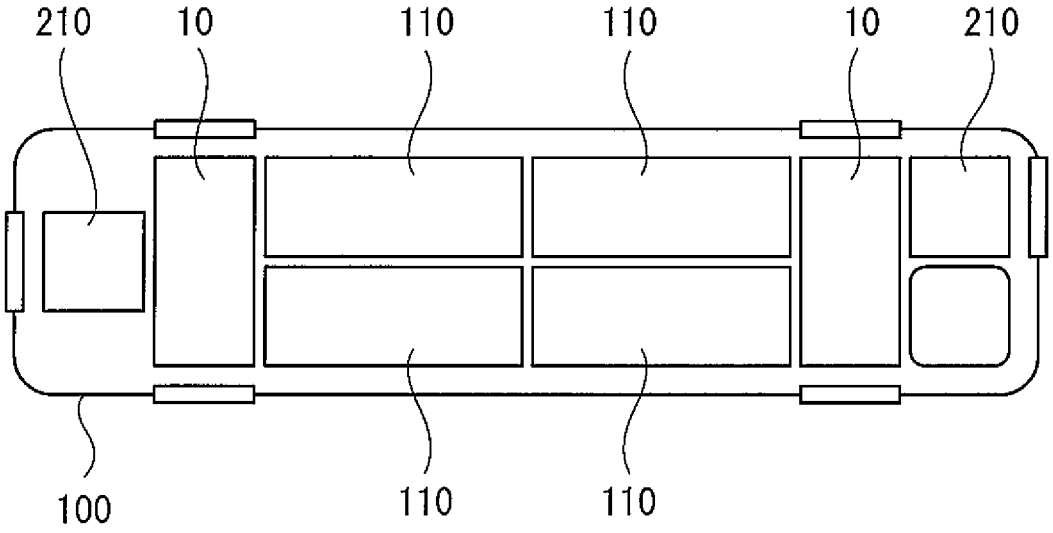
FIG. 5 is a schematic plan view showing a variant of the arrangement of floor panel units in a railcar.

In the present embodiment, the plurality of heater-equipped floor panels 10 are arranged along the car longitudinal direction, with their long sides extending in the car width direction. However, the present embodiment is not limited to this. For example, as shown in FIG. 5, there may be provided not only the heater-equipped floor panels 10 arranged along the car width direction with their long sides extending in the car width direction, but also heater-equipped floor panels 110 arranged along the car width direction with their long sides extending in the longitudinal direction of the carbody 100 and heater-equipped floor panels 210 which are square in shape. The arrangement pattern is not limited to those mentioned above.

In the present embodiment, the flanges 11 and 12 are provided at the long sides of the heater-equipped floor panels 10. However, depending on the arrangement pattern of the floor panels, the flanges may be provided at the short sides of the floor panels. The fastening members may be fixed to the floor-supporting member fixed to the underframe from above in the floor bodyshell or may be fixed directly to the underframe.

REFERENCE SIGNS LIST

1 heating floor structure
2 floor bodyshell
4 heating floor panel unit
5B, 5C fastening member
6 filler receiver
7 filler
10 heater-equipped floor panel
11 first flange
12 second flange
S space

The invention claimed is:

1. A heating floor panel unit of a railcar, the heating floor panel unit comprising:
- a heater-equipped floor panel;
- a first flange horizontally projecting from one of opposite ends of the heater-equipped floor panel and fixed to a carbody by a first fastening member;
- a second flange horizontally projecting from the other of the opposite ends of the heater-equipped floor panel and fixed to the carbody by a second fastening member; and
- a filler receiver, wherein:
- the first flange and the second flange are located at such a height that upper ends of the first fastening member and the second fastening member are located below an upper surface of the heater-equipped floor panel; and
- the first flange, as viewed from above, is located in such a manner that the first flange does not overlap the second flange; and
- the filler receiver has elasticity and is located above the upper ends of the first fastening member and the second fastening member such that the filler receiver is configured to receive a filler and keep the filler away from the first fastening member and the second fastening member.

2. A heating floor structure of a railcar, the heating floor structure comprising:
- a plurality of heating floor panel units arranged with a space therebetween;
- a plurality of fastening members fixing the plurality of heating floor panel units to a carbody; and
- a filler filling the space, wherein:
- each of the plurality of heating floor panel units comprises
  - a heater-equipped floor panel,
  - a first flange horizontally projecting from one of opposite ends of the heater-equipped floor panel and fixed to the carbody by a first fastening member of the plurality of fastening members,
  - a second flange horizontally projecting from the other of the opposite ends of the heater-equipped floor panel and fixed to the carbody by a second fastening member of the plurality of fastening members, and
  - a filler receiver;
- the first flange and the second flange are located at such a height that upper ends of the first fastening member and the second fastening member are located below an upper surface of the heater-equipped floor panel;
- the filler receiver has elasticity, is press-fit in the space, and is located above the upper ends of the first fastening member and the second fastening member; and
- the first flange of one of the plurality of heating floor panel units is located at such a position that the first flange of the one heating floor panel unit, as viewed from above, does not overlap the second flange of another heating floor panel unit adjacent to the one heating floor panel unit.

3. The heating floor panel unit according to claim 1, wherein the filler receiver includes an elastic tube or a sponge.

4. The heating floor structure according to claim 2, wherein the filler receiver covers, from above, the plurality of fastening members located in the space.

* * * * *